US005082008A

United States Patent [19]

Johnson

[11] Patent Number: 5,082,008

[45] Date of Patent: Jan. 21, 1992

[54] SMOKING ARTICLE

[76] Inventor: Robert R. Johnson, 503 Penwood Rd., Louisville, Ky. 40206

[21] Appl. No.: 281,591

[22] Filed: Dec. 9, 1988

[51] Int. Cl.[5] ..... A24F 1/22; A24B 15/00

[52] U.S. Cl. ..... 131/194; 131/359; 131/198.1; 131/195

[58] Field of Search ..... 131/194, 198.1, 198.2, 131/359, 369, 195

[56] References Cited

U.S. PATENT DOCUMENTS 4,474,191 10/1984 Steiner ..... 131/198.2

*Primary Examiner*—V. Millin

*Assistant Examiner*—J. Doyle

[57] ABSTRACT

A smoking article includes a generally cylindrically shaped fuel column with a corrugated-shaped channel formed longitudinally through the fuel column and concentric therewith. A flavor releasing material coats the corrugated wall of the channel and the flavor material is aerosolized by the heat generated by the burning of the fuel column when it is ignited. A filter rod is coaxially located at one end of the fuel column.

8 Claims, 1 Drawing Sheet

SMOKING ARTICLE

BACKGROUND OF THE INVENTION

1. Field of the Invention

The present invention relates to smoking articles, and more particularly to a smoking article having a fuel column including a flavor releasing material which forms an aerosol when heated by the burning fuel column.

2. Discussion of the Prior Art

Smoking articles having a tobacco column with a tubular member therethrough, wherein the tube is filled with an aerosol releasing material are known. The following patents illustrate various known smoking articles of this type: U.S. Pat. No. 3,258,015 issued on June 28, 1966 to C. D. Ellis, et al; U.S. Pat. No. 3,356,094 issued on Dec. 5, 1967 to C. D. Ellis, et al; U.S. Pat. No. 4,340,072 issued on July 20, 1982 to Bolt, et al; U.S. Pat. No. 4,714,082 issued on Dec. 22, 1987 to Chandra K. Banerjie, et al; U.S. Pat. No. 4,715,389 issued on Dec. 29, 1987 to Duo Lynn, et al; and, U.S. Pat. No. 4,732,168 issued on Mar. 22, 1988 to James L. Resce, et al.

In U.S. Pat. Nos. 3,356,094; 4,340,072; and, 4,732,168, smoke from the burning tobacco is mixed with the aerosol and delivered to the smoker's mouth. In U.S. Pat. No. 4,715,389, a tobacco column has a central channel which holds a plug of carbonized tobacco with plugs of aluminum screen to both sides of the tobacco plug. Both smoke from the tobacco column and pyrolized products of the carbonized tobacco plug are delivered to the smoker's mouth. In U.S. Pat. No. 3,258,015, the aerosol from a nicotine-releasing composition located within a central tube passes through a nucleating chamber wherein the aerosol is cooled and condensed to droplets before being discharged to the smoker's mouth.

SUMMARY OF THE INVENTION

The present invention provides a straightforward arrangement of a smoking article for vaporizing a flavor material. The present invention further provides a smoking article utilizing a fuel element circumscribing a flavor releasing material whereby the burning of the fuel element vaporizes the flavor from the flavor releasing material.

More particularly, the present invention provides a smoking article having a generally cylindrically shaped fuel column having a hollow corrugated channel longitudinally coextensive with the fuel column open to both ends of the fuel column, and concentric with the fuel column. The channel walls being coated with a flavor releasing material which is volatilized or aerosolized by the heat generated by the burning of the fuel column. A filter rod may be coaxially located at one end of the fuel rod and is attached to the fuel column by tipping paper which circumscribes the filter rod and circumferentially overlaps the fuel column adjacent the interface of the fuel column and filter rod.

Various other features of the present invention become obvious to those skilled in the art upon reading the disclosure set forth hereinafter.

BRIEF DESCRIPTION OF THE DRAWINGS

A better understanding of the invention will be had upon reference to the following description in conjunction with the accompanying drawings wherein.

DETAILED DESCRIPTION OF THE PREFERRED EMBODIMENTS

Figure 1:
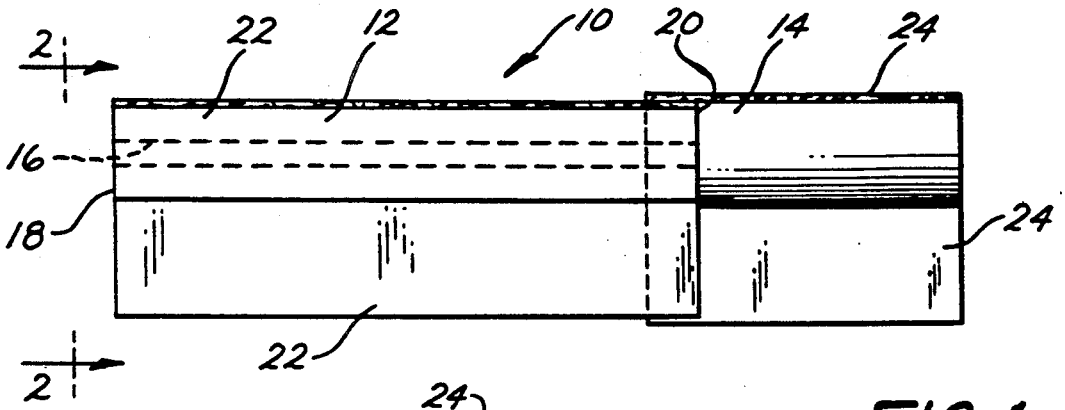
FIG. 1 is a longitudinal cross-sectional view of one embodiment of the smoking article of the present invention.
Figure 2:
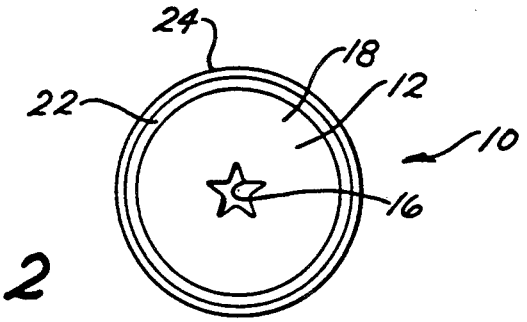
FIG. 2 is a transverse cross-sectional view as seen in the direction of arrows 2—2 in FIG. 1.

With reference to FIGS. 1 and 2, there is shown a smoking article, generally denoted as the numeral 10, of the present invention which includes a generally cylindrical fuel column 12 and a filter rod 14.

The fuel column 12 can be fabricated of a non-tobacco, combustible material, such as a carbon, for example charcoal. The fuel material can be impregnated or admixed with an aerosol forming material such as, for example, glycerine, which will aerosolize at the temperature of the burning fuel material of the fuel column. The fuel column 12 can also be fabricated of a tobacco material, or an admixture of tobacco material and a combustible non-tobacco material such as charcoal.

The fuel column 12 is formed with a hollow channel 16 which is concentric with, and extends coextensively longitudinally of the fuel column 12 so that it is open to both ends 18 and 20 of the fuel column 12. The wall of the channel 16 is corrugated with the corrugations extending longitudinally of the channel 16 the entire length of the channel 16.

A flavor releasing composition containing a flavor releasing material, such as, for example, a nicotine containing material, or menthol or a combination of nicotine containing material and menthol on finely divided tobacco could coat the corrugated wall of the channel 16. The flavor composition can also include an aerosol forming material, such as glycerine. It is contemplated that the flavor composition will impregnate the fuel column 12 in the proximity of the wall of the channel 16. The corrugations of the channel 16 should be large in order to provide a large surface area to release aerosol and flavors and also, to provide a large surface area to assist in cooling the released aerosol downstream of the burning coal.

The fuel column 12 can be circumferentially wrapped with a paper wrapper 22. If the paper wrapper 22 is used, it is preferably of the type having a controlled burn rate which emits little visible smoke, commonly referred to as sidestream smoke.

The filter rod 14 is coaxially located at one end 20 of the fuel column 12 so that it is in flow communication with both the material of the fuel column 12 and the channel 16. The filter rod 14 has a high mass so that it will cool and disperse the hot gases.

The filter rod 14 is attached to the fuel column 12 by a circumscribing tipping material 24 which circumferentially overlaps the adjacent end of the fuel column 12. The tipping material 24 can be permeable to air so that ambient air can flow into the body of the filter rod.

Figure 3:
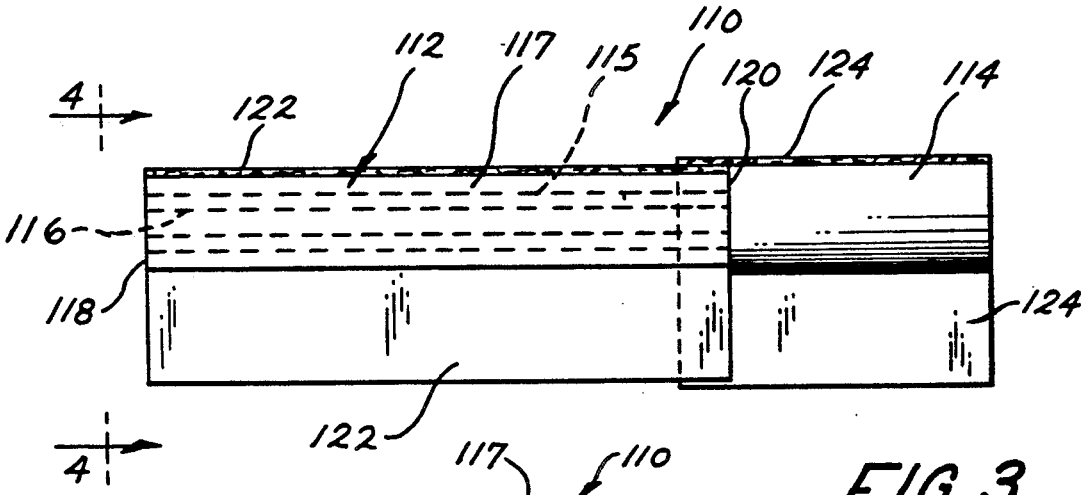
FIG. 3 is a longitudinal cross-sectional view of another embodiment of the smoking article of the present invention; and, FIG. 4 is a transverse cross-sectional view as seen in the direction of arrows 4—4 in FIG. 3.
Figure 4:
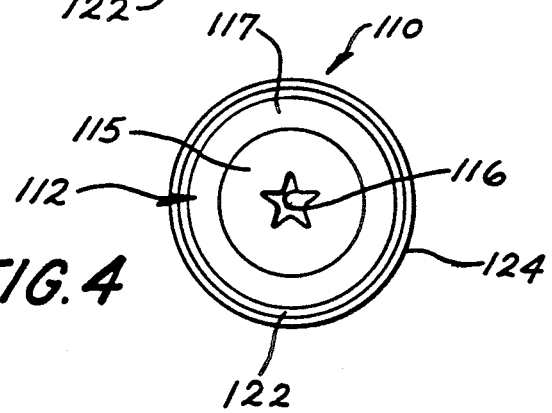

Now with reference to FIGS. 3 and 4, there is shown a smoking article, generally denoted as the numeral 110, of the present invention which includes a generally cylindrical fuel column 112 and a filter 114.

The fuel column 112 has a first or inner column 115 fabricated of a tobacco material, including an aerosol forming material such as glycerine, and a second or outer column 117 fabricated of a combustible fuel material other than tobacco such as charcoal. The inner column 115 is concentric with and longitudinally coextensive with the outer column 117.

The fuel column 112 is formed with a hollow channel 116 which is concentric with, and extends longitudinally coextensively with the inner column 115 so that it is open to both ends 118 and 120 of the fuel column 112. The wall of the channel 116 is corrugated with the corrugations extending longitudinally of the channel 116 the entire length of the channel 116.

The fuel column 112 can be circumferentially wrapped with a paper wrapper 122. If the paper wrapper 122 is used, it is preferably of the type having a controlled burn rate which emits little visible smoke, commonly referred to as sidestream smoke.

The filter rod 114 is coaxially located at one end 120 of the fuel column 112 so that it is in flow communication with both the inner column 115, the outer column 117, and the channel 116. The filter rod 114 is attached to the fuel column 112 by a circumscribing tipping material 124 which circumferentially overlaps the adjacent end of the fuel column 112. The tipping material 124 can be permeable to air so that ambient air can flow into the body of the filter rod 114. The filter rod 114 has a high mass so that it will cool and disperse the hot gas.

It is contemplated that the fuel columns 12 and 112 can be formed by an extrusion process. In the process of extruding the fuel column 12, the fuel material having the channel 16 and flavor composition can be coextruded with the fuel material located concentrically around the flavor composition. As the fuel column 12 is leaving the extruding process, the flavor composition will be absorbed into the surrounding fuel material through the wall of the channel 16. In the process of extruding the fuel column 112, the non-tobacco fuel of the outer column 117 and the inner column 115 of tobacco material can be coextruded with the fuel material of the outer column 117 located concentrically around the tobacco material of the inner column 115.

The foregoing detailed description is given primarily for clearness of understanding and no unnecessary limitations are to be understood therefrom.

What is claimed is:

1. A smoking article comprising:

a fuel column comprising an inner column of tobacco material, and an outer column of a non-tobacco combustible fuel material longitudinally coextensive with and concentrically surrounding the inner column; and, a corrugated channel longitudinally extending through the inner column, the channel being coextensive with and concentric to the inner column such that the channel is open to both ends of the fuel column.

2. The smoking article of claim 1, including a filter rod coaxially located at one end of the fuel column.

3. The smoking article of claim 2, further comprising tipping material circumscribing the filter rod and circumferentially overlapping the adjacent end of the fuel column.

4. The smoking article of claim 3, wherein the tipping material is impermeable to air flow.

5. The smoking article of claim 3, wherein the tipping material is permeable to air flow.

6. The smoking article of claim 1, wherein a flavor composition impregnates the inner fuel column in the proximity of the corrugated channel.

7. The smoking article of claim 6, wherein the flavor composition includes an aerosol forming material.

8. The smoking article of claim 1, wherein the inner fuel column includes an aerosol forming material.

* * * * *